United States Patent [19]

Mueller et al.

[11] 3,941,778

[45] Mar. 2, 1976

[54] BIS(TRIAZINYLAMINO) STILBENE COMPOUNDS

[75] Inventors: Curt Mueller, Binningen; Hans-Rudolf Schmid, Riehen, both of Switzerland

[73] Assignee: Sandoz Ltd., (Sandoz AG), Basel, Switzerland

[22] Filed: Feb. 15, 1974

[21] Appl. No.: 442,920

[30] Foreign Application Priority Data

Feb. 21, 1973 Switzerland ..... 2521/73

[52] U.S. Cl. ..... 260/240 B; 162/162; 252/301.2 W; 252/301.3 W

[51] Int. Cl.[2] ..... C07D 403/12

[58] Field of Search ..... 260/240 B

[56] References Cited

UNITED STATES PATENTS

| | | | |
|---|---|---|---|
| 3,589,921 | 6/1971 | Allison et al. | 260/240 B |
| 3,635,721 | 1/1972 | Sato et al. | 260/240 B |
| 3,759,900 | 9/1973 | Horstmann | 260/240 B |

FOREIGN PATENTS OR APPLICATIONS

| | | | |
|---|---|---|---|
| 969,402 | 9/1964 | United Kingdom | 260/240 B |

OTHER PUBLICATIONS

Hausermann et al. *Textil—Rundschau* 16 (1961) pp. 176–180.

Nakazawa et al. *Chem. Abstracts* 69(1968) No. 82311*p*.

Guenter et al. *Chem. Abstracts* 78(1973) No. 112679*n*.

Yamashita *Chem. Abstracts* 76(1972) No. 60909*g*.

*Primary Examiner*—Arthur P. Demers

*Attorney, Agent, or Firm*—Gerald D. Sharkin; Richard E. Vila; Joseph J. Borovian

[57] ABSTRACT

New stilbene derivatives of formula:

I in which $R_1$ signifies a hydrogen or halogen atom, or a lower alkyl group;

$R_2$ signifies a hydrogen atom; a cycloalkyl group which is unsubstituted or substituted by one or more lower alkyl groups; or a lower alkyl group which is unsubstituted or substituted by a hydroxyl, lower alkoxy or hydroxysubstituted lower alkoxy group or by a radical of formula (a);

(a) ;

M signifies a hydrogen atom or an equivalent of a colourless cation;

*n* signifies 1 or 2; Alkylene signifies $C_{1-8}$ alkylene;

and the rings A and B are unsubstituted or substituted by one or more substituents selected from halogen atoms and lower alkyl, lower alkoxy, cyano and $SO_3M$ groups;

the compound containing at least six $SO_3M$ groups per molecule, are useful as optical brighteners. They are produced by successive condensation of each of the three amino-containing moieties around the triazine nucleus, as an amine, with a cyanuro halide. Their application, particularly in certain liquid preparations, for the optical brightening of paper and textiles is described.

14 Claims, No Drawings

BIS(TRIAZINYLAMINO)STILBENE COMPOUNDS

The present invention relates to stilbene derivatives which contain sulphonic acid groups.

According to the invention, there are provided compounds of formula I:

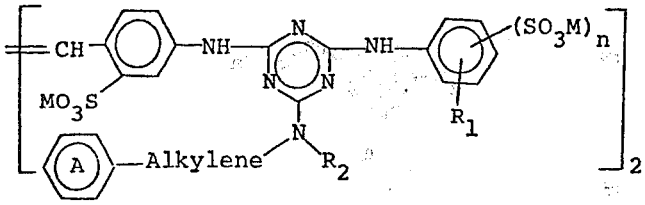

I in which $R_1$ signifies a hydrogen or halogen atom, or a lower alkyl group;

$R_2$ signifies a hydrogen atom; a cycloalkyl group which is unsubstituted or substituted with one or more lower alkyl groups; or a lower alkyl group which is unsubstituted or substituted with a hydroxyl, lower alkoxy or hydroxysubstituted lower alkoxy group or with a radical of formula (a);

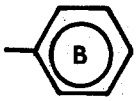

(a);

M signifies a hydrogen atom or an equivalent of a colourless cation;

*n* signifies 1 or 2;

and the rings A and B are unsubstituted or substituted with one or more substituents selected from halogen atoms and lower alkyl, lower alkoxy, cyano and $SO_3M$ groups, the compounds containing at least six $SO_3M$ groups per molecule.

As examples of lower alkyl and alkoxy groups in the compounds of formula I may be given those containing 1 to 8 carbon atoms, preferably 1 to 4 carbon atoms, and more preferably 1 or 2 carbon atoms. Any lower alkyl or alkoxy group containing 3 or more carbon atoms may be straight or branched. Specific examples of lower alkyl groups or the alkyl moieties in lower alkoxy groups are methyl, ethyl, n-propyl, isopropyl, n-butyl, isobutyl, tert.-butyl, n-pentyl, isopentyl, n-hexyl and isooctyl.

Any lower alkyl moeity substituted with a hydroxyl or alkoxy group preferably contains 2 to 4 carbon atoms, more preferably 2 or 3. Examples of preferred hydroxy-substituted lower alkyl groups are β-hydroxyethyl and β-hydroxypropyl, of which the former is the more preferred.

By the term "halogen" as used herein is to be understood fluorine, chlorine or bromine, of which chlorine is the preferred halogen.

As examples of cycloalkyl groups may be given cyclopentyl and cyclohexyl, of which the latter is the preferred cycloalkyl group. Such groups may be substituted with one or more lower alkyl groups, preferably 1 to 3 lower alkyl groups, and examples of such substituted cycloalkyl groups are mono-, di- and trimethylcyclohexyl and ethylcyclohexyl.

In the compounds of formula I, the alkylene radical preferably contains 1 to 8 carbon atoms, and when containing 2 or more carbon atoms, may be straight or branched. Examples of such radicals are methylene, ethylidene, ethylene, 1- or 2-methylethylene, trimethylene, butylene-1,2, -1,3, -1,4 and -2,3, 1,1,3-trimethyltetramethylene and isooctylene, e.g., 6,6-dimethylhexamethylene or 6-methylheptamethylene. Preferably the alkylene radical contains 1 to 4 carbon atoms, and more preferably, 1 or 2 carbon atoms.

When ring A or B is substituted, the substituents in each case are preferably selected from 1 to 3 lower alkyl groups, 1 or 2 lower alkoxy groups, halogen atoms, a cyano group and a $SO_3M$ group. Examples of the substituted rings A or B are methylphenyl, in particular o- or p-methylphenyl, ethylphenyl, in particular p-ethylphenyl, 2,4,6-trimethylphenyl, 2- or 3-methoxy-4- or 5-methylphenyl, 3-methyl-4-methoxyphenyl, 2-, 3- or 4-methoxyphenyl, 4-chlorophenyl, 2,4- or 2,5-dichlorophenyl, 4-cyanophenyl, 4-sulphophenyl, 2- or 3-methyl-4-sulphophenyl and 4-tert.-butyloxyphenyl. Preferably rings A and B do not contain a $SO_3M$ group, and more preferably, they are each unsubstituted.

As examples of M, when signifying an equivalent of a colourless cation, may be given those commonly used in optical brightening agents, such as alkali metals, e.g., lithium, sodium and potassium, alkaline earth metals, e.g., magnesium, calcium and strontium, and ammonium and substituted ammonium, e.g., of the formula $NR_3R_4R_5R_6$, wherein each of $R_3$, $R_4$, $R_5$ and $R_6$, independently, signifies a hydrogen atom or an alkyl group containing up to 4 carbon atoms, which is unsubstituted or substituted with 1 or 2, preferably one, hydroxyl groups, examples of such ammonium cations being mono-, di- and triethanolammonium ions. It is to be understood that whilst M is shown for simplicity as being monovalent, it may be multivalent, particularly divalent, e.g. when signifying an alkaline earth metal cation. In such a case of multivalency, the appropriate cation is shared between sufficient anionic sulpho moieties to render the particular compound of formula I electrically neutral.

The symbol n preferably signifies 2, and one of the corresponding two $SO_3M$ groups is preferably in the ortho-position, with respect to the position of attachment of the linking moiety —NH—, the other —$SO_3M$ group preferably being in either the meta- or the para-position thereto, the former of the two being preferred.

A preferred class of compounds of the invention comprises those compounds of formula I wherein $R_1$ signifies a hydrogen atom. A second preferred class is represented by the formula I wherein $R_2$ signifies a hydrogen atom, an alkyl group containing 1 to 4 carbon atoms, β-hydroxyethyl, β-hydroxypropyl or benzyl. Preferably the alkylene radical of the compounds of formula I contains from 1 to 4 carbon atoms. Ring A or ring B is preferably unsubstituted.

A more preferred class of compounds of the invention comprises those having the formula I wherein $R_1$ and $R_2$, the alkylene radical and the rings A and B are restricted to the moieties described in the previous paragraph.

Especially preferred compounds of the invention are those having the formula I':

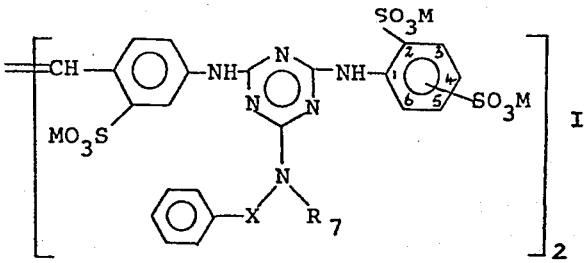

I' in which $R_7$ signifies a hydrogen atom or a methyl, ethyl, isopropyl, β-hydroxyethyl or benzyl group;

x signifies methylene, ethylene, tri- or tetramethylene, $-(CH_2)_2CH(CH_3)-$ or ethylidene; and M is as defined above, but preferably signifies an alkali metal, particularly sodium, the second $SO_3M$ moiety on the 2—($SO_3M$)-substituted phenyl group being attached at either the 4- or the 5-position.

Even more preferred compounds of the invention are those of the formula I' wherein X signifies methylene.

According to a further feature of the present invention there is provided a process for preparing the compounds of formula I, characterised by reacting a cyanuro halide of formula II:

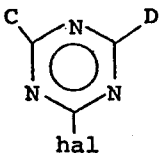

II in which C and D signify, respectively, the groups:

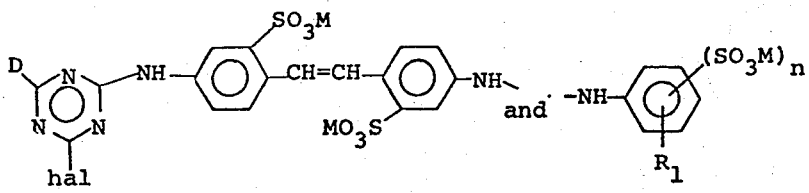

or

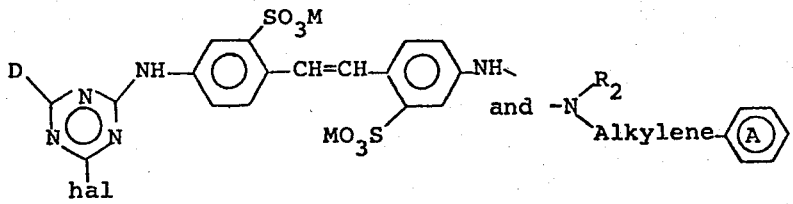

or

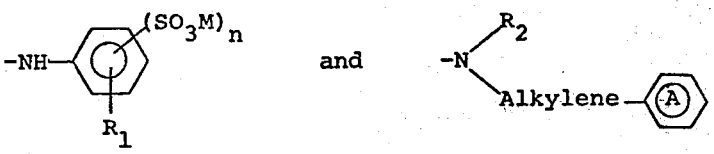

and hal signifies a halogen atom; with, respectively, an amine of formula III, IV or V:

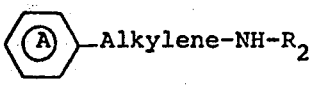

III

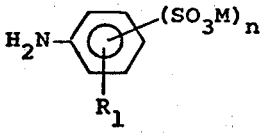

IV

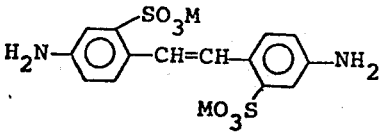

V

It is to be understood that each of the 3 alternative starting materials, of formula II, are preparable by reacting a cyanuro halide of formula VI:

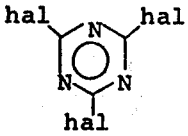

VI with the amines CH and DH, in either order.

The preferred starting material of formula II is one in which the halogen atom signified by "hal" is a chlorine atom.

The reaction step in each alternative embodiment of the process of the invention may be effected in accordance with a method known per se, whereby the temperature of the preparative reaction is generally kept within the range 80° to 100°C and the pH within the range 4 to 10. During the course of the reaction step the hydrohalic acid freed is conveniently removed from the system by neutralisation with a base, e.g., an alkali metal hydroxide, bicarbonate or carbonate, or an organic tertiary amine as exemplified by tri-(2-hydroxyethyl)-amine.

As starting materials of formula IV may be used mono- or preferably disulphonic acids or appropriate salts thereof, e.g. 1-amino-2-methylbenzene-4,5- or -4,6-disulphonic acid, 1-amino-3-methylbenzene-2,4- or -4,6-disulphonic acid, 1-amino-4-methylbenzene-3,5-disulphonic acid, 1-amino-4-methylbenzene-3,5-disulphonic acid, 1-amino-3-chlorobenzene-4,6-disulphonic acid, 1-amino-4-chlorobenzene-3,6-disulphonic acid and, preferably, 1-aminobenzene-3,5-disulphonic acid and, more preferably, 1-aminobenzene-2,4- and -2,5-disulphonic acid.

The molar proportion by which the compound of formula II is suitably reacted with one of the compounds of formulae III, IV and V depends on the nature of the appropriate compound of formula III, IV or V. If the latter compound is of formula III or IV, approximately equimolar proportions of compounds of formulae II and III or IV are suitably reacted, whereas if compounds of formulae II and V are reacted together, 2 moles of the compound of formula II are suitably reacted with approximately 1 mole of the compound of formula V.

As regards the formation of the starting material of formula II from a cyanuro halide of formula VI and the amines CH and DH, the same principles apply in choosing suitable molar proportions of starting materials as are evident from the previous paragraph. Accordingly, 2 moles of the compound of formula II are suitably reacted with approximately 2,2 or 1 moles, respectively, of the compound of formula III, IV or V, followed by approximately 2, 1 or 2 moles, respectively, of the compound of formula IV, V or III.

The individual reaction steps in arriving at the starting materials of formula II may be effected in accordance with methods known per se, whereby the first halogen atom of the cyanuro halide of formula VI is replaced by a radical derived from one of the compounds of formulae III, IV and V generally within the temperature range 0° to 15°C and pH range 1 to 7, while the second halogen thereof is replaced by the appropriate radical as hereinbefore mentioned within the temperature range 20° to 60°C and pH range 4 to 8. In each case the appropriate hydrohalic acid freed in the course of each reaction step is conveniently removed from the system by neutralisation with a base, e.g. an alkali metal hydroxide, bicarbonate or carbonate, or an organic tertiary amine as exemplified by tri-(2-hydroxyethyl)amine.

It is to be understood that, overall, the reaction scheme providing a compound of the invention of formula I from the starting point of the cyanuro halide of formula VI consists in reacting the latter compound with, in any order, compounds of the formulae III, IV and V. However, it is preferred to react the compound of the formula II with first that of formula IV, then of formula V, and finally of formula III.

The compounds of formula I may be isolated and purified in conventional manner.

As will be appreciated, the particular significance of M may be introduced during production of compounds of formula I, e.g. by employing starting materials in which M has such significance or by employing pH regulating agents, such as soda to introduce the significance sodium etc. Alternatively, however, and again as will be appreciated, the significance of M, as obtained initially in the compounds of formula I may be exchanged, in conventional manner, for any other desired significance thereof.

The compounds of formula I are useful as optical brightening agents.

The compounds of the formula I are readily soluble in water, particularly when in the form of alkali metal, alkaline earth metal or ammonium salts, especially di- or triethanolammonium salts. Furthermore, concentrated aqueous, aqueous-organic or organic solutions may be produced therewith, containing, for example, up to about 30% of the solute of formula I in the absence of a solvent aid, or containing, for example, up to about 50% of the solute of formula I, particularly when present in highly salt-free form, in the presence of a solvent acid. Examples of solvent aids useful for effecting the dissolution of the compounds of formula I are urea, triethanolamine and glycols, e.g. ethylene and propylene glycols, and polyglycolic ethers of molecular weight up to about 1000, and mixtures thereof.

The use of such liquid preparations enables the compounds of the invention, which have fluorescent properties, to be conveniently applied to substrates as optical brighteners. A preferred composition of such a liquid preparation is as follows, all percentages being by weight:

20–25% compound of formula I in highly purified form, i.e. in a substantially salt-free form
10–30% solvent aid, e.g. as hereinbefore exemplified
70–20% water.

When glycols or lower polyglycolic ethers (e.g. diethylene glycolic ethers or triethylene glycolic ethers or the corresponding propylene glycolic ethers) or mixtures thereof are used as solvent aids, such agents may partially serve as solvents. Taken further, the "solvent aid" may completely replace water in the composition such that the solvent aid is then a solvent per se for the compound of the invention. A more preferred composition of a liquid preparation containing a compound of the invention, which extends to such a water-free composition, is as follows, again all percentages being by weight:

20–50% compound of formula I in substantially salt-free form
5–50% glycols or lower polyglycolic ethers or mixtures thereof
75–0% water.

The compounds of formula I are particularly suitable for the optical brightening of organic high polymer compounds, e.g., natural or regenerated cellulose, natural or synthetic polyamide and plastics, e.g. polyurethane, and synthetic resins. Generally binding agents are also employed in such brightening processes, for example in the production or finishing of paper and in the finishing, particularly high grade finishing, of textile materials.

Due to their good hydro-solubility, the compounds of formula I are suitable for the optical brightening of paper in the stock. Furthermore, due to their comparatively low substantivity, they are suitable for the brightening of paper in the dipping process or of textiles, especially cellulosic textiles and non-woven fabrics, in the padding process. They may also be used for the brightening of polyamides from an acid bath or of nylon or regenerated cellulose in the spinning mass.

In the application of the compounds as optical brighteners for paper, they are preferably used after sheet formation, especially in paper sizing solutions as employed in the size press, and in paper coating media.

When used in the processing of textiles, they are preferably employed in synthetic resin baths, preferably for finishing cotton, and particularly for effecting crease-proof finishing.

For the optical brightening of paper in the stock, a proportion of optical brighteners to air-dried cellulose within the range 0.01 to 0.5% by weight is preferably employed. Sizing liquors containing 0.3 to 8g and preferably 0.5 to 6g of optical brightener per liter of the treatment liquor are suitable for the treatment of paper in the size press. The amount of the brightener will naturally depend on the amount and kind of the binding agent used, the paper and the degree of whiteness required. In normal cases, the concentration of the binding agent is within the range 2 to 15% by weight of the bath liquor. For the surface treatment of papers other additives may also be present in the treatment liquor in the bath, e.g. white pigments or fillers, e.g. for the coating mass. Such additives usually constitute 10 to 65% by weight of the coating mass. Binding agents also present usually constitute 5 to 25% by weight, and the optical brightener approximately 0.3 to 6g per liter of coating mass. Suitable binding agents include decomposed starch, alginates, gelatine, polyvinyl alcohol, polyvinyl pyrrolidone, carboxymethyl cellulose, casein, protein, polyvinylidene chloride or mixtures of such binding agents. From these binding agents, decomposed starch, polyvinyl alcohol and carboxymethyl cellulose are preferred. Aqueous synthetic resin dispersions based on co-polymerisation of acryl or butadiene styrene resins are also suitable binding agents, there being present about 50% of synthetic resin. Suitable white pigments or fillers include common agents such as china clay, calcium carbonate, satin white, blancfix, titanium oxide, talc and precipitated aluminium silicates, as well as mixtures thereof.

Furthermore, the coating pastes may advantageously contain hydrosoluble poly- or metaphosphates, and as wetting agents, unsulphated or sulphated higher alkanol or alkylphenol polyglycolic ethers containing $C_{1-14}$ alkyl groups and 1 to 20 ethylene oxide groups. For the obtention of good flow properties, an alkaline coating paste is preferably used for the pigment coating, the alkaline reacting conveniently being effected with, inter alia, ammonium hydroxide or sodium or potassium hydroxides, carbonates, borates, perborates or mixtures thereof.

In the application of the compounds of the invention as optical brighteners in the finishing of textiles, the compounds are preferably used in an amount within the range 0.05 to 0.8% by weight of the substrate. The bath length is preferably in a ratio of 1:10 to 1:50 and the treatment temperature is in a range of 30° to 60°C. Furthermore the bath may advantageously contain other adjuvants.

In padding processes, particularly continuous ones, the concentration of the optical brightener is preferably from 0.02 to 1.2%, more preferably from 0.05 to 0.8% by weight of the substrate. Thereafter the brightener may be fixed in accordance with the cold retention process or in the heat, optionally after an intermediate drying.

For the finishing of textiles (woven or non-woven fabrics) with binding agents, especially synthetic resins, the optical brightener, preferably in amount 0.02 to 1.2%, or more preferably, 0.05 to 0.8%, by weight of the substrate, may be added to the synthetic resin in the treatment bath, or even before. The fixation of the optical brightener and the cross-linking of the finishing agent may be effected in accordance with the cold retention process or the method of wetting out in the cold, or by heat treatment, optionally after an intermediate drying. Due to their stability in a strongly acid bath and towards salts, e.g. magnesium chloride and zinc chloride, the compounds of formula I are very suitable for the optical brightening and simultaneous crease-proof finishing of cotton fabrics. The synthetic resins used as binding agents for the finishing of textiles are preferably those derived from formaldehyde and amides, e.g. from formaldehyde and urea, ethylene urea, propylene urea, mono- or dihydroxyethylene urea, guanidine, melamine or urethanes such as methyl or ethyl urethane. Particularly preferred resins are those derived from formaldehyde and urea or a substituted urea.

The compounds of formula I are notably acid and salt resistant. They are particularly resistant towards aluminium salts as used in paper production and towards magnesium and zinc salts as used in synthetic resin finishing. Application of the compounds to substrates results in an increase in fluorescence, a neutral shade and good fastness properties. Use of the compounds of formula I in combination with other brightening agents provides special effects. Furthermore, the compounds of the invention may be blended with conventional hydrophilic blending agents, e.g. polyvinyl alcohol, optionally acylated polyethylene glycols, polyvinyl pyrrolidone or urea. In some cases the resulting brightening effect may be considerably increased.

The following Examples illustrate the invention. Unless otherwise stated, the parts and percentages are by weight, and the parts by volume relate to the parts by weight as milliliters to grams. All temperatures are in degrees centigrade.

EXAMPLE 1

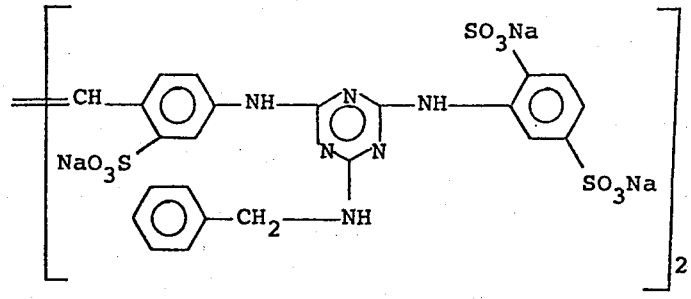

VII

A solution of 190 parts of cyanuro chloride in 800 parts by volume of acetone is run with stirring, over the course of 10 minutes, into 5000 parts of ice water. A solution of 253 parts of aniline-2,5-disulphonic acid and 106 parts of calcinated soda in 1500 parts of water is added dropwise at 0° to 5° over the course of 1 hour and with stirring. The pH is kept at 3 to 4 by the dropwise addition of 15% soda solution. The suspension is thus slowly dissolved. The solution is stirred at 0° to 5° until no primary, aromatic amino groups may be detected any longer by the diazo reaction. A solution of 185 parts of 4,4'-diamino-stilbene-2,2'-disulphonic acid and 106 parts of calcinated soda in 1500 parts of water are subsequently added, the pH is adjusted to 7 by the addition of 15% soda solution and the solution is heated to 30° until the diazo reaction turns negative. 150 Parts of benzyl amine are added to the clear solution, the pH is increased to 9 to 10 by the addition of 15% soda solution and the solution is slowly heated to 95°–100° with distillation of the acetone. The solution is boiled at reflux over the course of 1½ hours, the pH being kept at 9 to 10 by the addition of soda solution. 350 Parts of sodium chloride are subsequently added to the clear solution which is then allowed to cool. The bright lemon yellow product precipitates, is suction filtered and dried under vacuum. The resulting brightener corresponds to the above-indicated formula VII.

Similar brighteners are obtained by replacing 150 parts of benzyl amine by 169 parts of 1-phenylethyl amine or 169 parts of 2-phenylethyl amine or 189 parts of 3-phenylpropyl amine or 209 parts of 4-phenylbutyl amine or 209 parts of 3-amino-1-phenyl-butane or 169 parts of N-methyl-N-benzyl amine or 209 parts of N-isopropyl-N-benzylamine or 275 parts of dibenzyl amine or 212 parts of 2-benzylamino-ethanol. The resulting brighteners correspond to formula:

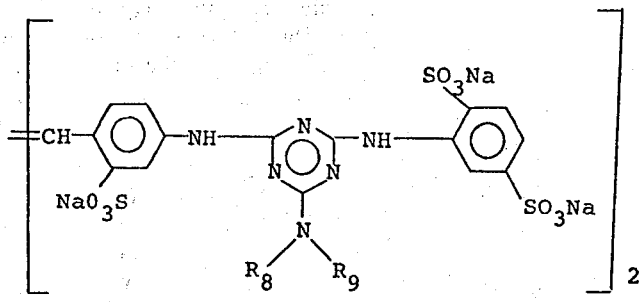

wherein the symbols $R_8$ and $R_9$ have the significances stated in the following Table.

| | $R_8$ | $R_9$ |
|---|---|---|
| a | $-C_6H_4-CH(CH_3)-$ | H |
| b | $-C_6H_4-CH_2-CH_2-$ | H |
| c | $-C_6H_4-CH_2-CH_2-CH_2-$ | H |
| d | $-C_6H_4-CH_2-CH_2-CH_2-CH_2-$ | H |
| e | $-C_6H_4-CH_2-CH_2-CH(CH_3)-$ | H |
| f | $-C_6H_4-CH_2-$ | $CH_3-$ |
| g | $-C_6H_4-CH_2-$ | $(CH_3)_2CH-$ |
| h | $-C_6H_4-CH_2-$ | $-C_6H_4-CH_2-$ |
| i | $-C_6H_4-CH_2-$ | $HO-CH_2-CH_2-$ |

EXAMPLE 2

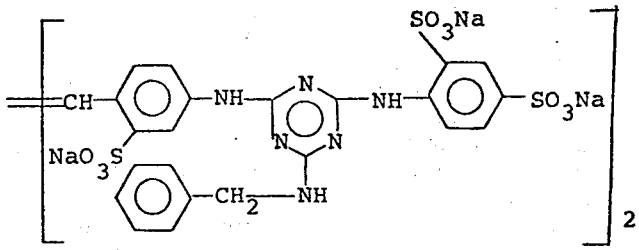

VIII

By processing as in the above Example but replacing the 253 parts of aniline-2,5-disulphonic acid by 253 parts of aniline-2,4-disulphonic acid, the aboveindicated compound is obtained. The benzyl amine radical may be replaced in analogous manner by the amine radicals indicated in Example 1.

EXAMPLE 3

525 Parts of ethylene glycol are added to the well expressed residue of Example 1. The mixture is adjusted with water to a weight of 3200 parts and slightly heated with stirring until a clear solution is obtained.

A similar solution is obtained by replacing ethylene glycol by diethylene glycol or a mixture of ethylene glycol/diethylene glycol 1:1 or 700 parts of urea.

EXAMPLE 4

A cotton fabric is drawn through a bath containing:
240 parts of a synthetic resin pre-condensate, e.g. dimethylol ethylene urea,
28 parts of sulphuric acid 40° Be
6 parts of a brightener of Example 1
730 parts of water,
expressed between two rollers to a pick up of 100% and dried at 90° until a residual humidity of 8% is obtained. The fabric is subsequently rolled up and stored at room temperature over the course of 17 hours. It is cold rinsed, cold neutralised with a solution of 2g/l of soda, cold rinsed, expressed and dried at 100°. The fabric treated in this way shows a good brilliant brightening of neutral shade.

EXAMPLE 5

A cotton fabric is drawn through a solution, containing 3 parts of a brightener of Example 2 in 1000 parts of solution, expressed to a pick up of 100% and dried at 60°–70°. The fabric shows a good brightening. The brightening effect is considerably increased by adding 8 parts of a polyethylene glycol (with a molecular weight of 5000 to 6000).

EXAMPLE 6

A sized paper of sulphit cellulose is coated with a coating paste consisting of
66 parts of kaolin
33 parts of water
10 parts of a 50% dispersion of a butadiene-styrene-copolymer
5 parts of a 10% casein solution
0.3 parts of a 10% solution of a brightener of Example 1.

The degree of whiteness is considerably higher than that of an unbrightened coating paste. The effect is considerably improved by adding to the coating paste 1 part of a 10% solution of a polyethylene glycol having a molecular weight of 4000 to 6000.

EXAMPLE 7

To a suspension of 100 parts of bleached sulphite cellulose in 4000 parts of water, ground in a hollander engine to 40°-Schopper-Riegler and containing 10 parts of aluminium sulphate, is added a solution of 0.3 parts of a brightener of Example 1 in 300 parts of water. The solution is carefully mixed over the course of 30 minutes. The cellulose mass is subsequently sized in conventional manner with 20 parts of a 10% colophonium resin size and 3 parts of aluminium sulphate, dissolved in 10 parts of water. The mass is then diluted with water to 20,000 parts and processed into paper sheets.

The paper thus produced shows a good brightening. The result indicates that the brighteners produced in accordance with the invention may also be used in the paper mass at low pH values. This is of importance for the paper production as the process has to be effected with backwater which contains plenty of aluminium sulphate.

EXAMPLE 8

A coating mass consisting of
66 parts of kaolin
33 parts of water
10 parts of a 50% dispersion of a butadienestyrene copolymer
1 part of a 10% solution of a polyethyleneglycol having a molecular weight of 5000 to 6000
0.3 parts of a 10% solution of a brightener of Example 2 or 1 is applied by means of a coating apparatus to a sized paper consisting of 50% bleached sulphite cellulose and 50% mechanical wood pulp. A paper with an excellent brightening effect is obtained.

5 Parts of a 10% solution of a decomposed starch may furthermore be added to the above-mentioned coating paste. The brightening effect is thereby slightly improved.

What is claimed is:

1. A compound of formula I,

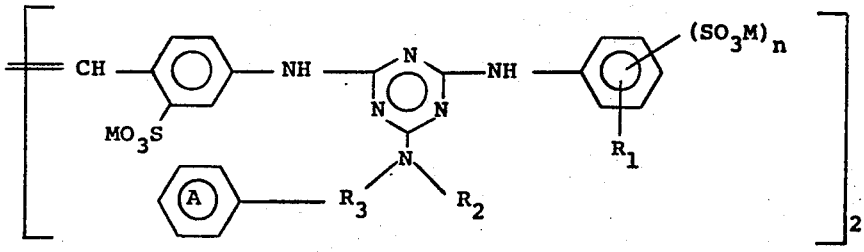

I wherein $R_1$ is hydrogen, fluoro, chloro, bromo or $C_{1-8}$ alkyl;

$R_2$ is hydrogen, cyclopentyl, cyclopentyl substituted by one to three $C_{1-4}$ alkyl groups, cyclohexyl, cyclohexyl substituted by one to three $C_{1-4}$ alkyl groups, $C_{1-4}$ alkyl, $C_{2-4}$ alkyl monosubstituted by hydroxy, $C_{1-4}$ alkoxy or $C_{2-4}$ hydroxyalkoxy, or $C_{1-4}$ alkyl substituted by a radical of formula (a),

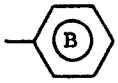

(a)

$R_3$ is $C_{1-8}$ alkylene;

M is hydrogen or an equivalent of a colourless cation;

$n$ is 1 or 2;

and the rings A and B are unsubstituted or substituted by 1 to 3 $C_{1-8}$ alkyl groups, 1 or 2 substituents selected from $C_{1-8}$ alkoxy, fluoro, chloro and bromo or one substituent selected from cyano and $-SO_3M$;

the compound containing at least six $-SO_3M$ groups per molecule.

2. A compound of claim 1, wherein any $C_{1-8}$ alkyl or alkoxy radical is of 1 to 4 carbon atoms.

3. A compound of claim 1, wherein any cyclopentyl or cyclohexyl radical as $R_2$ is a cyclohexyl radical.

4. A compound of claim 3, wherein $R_3$ is of 1 to 4 carbon atoms.

5. A compound of claim 1, wherein ring A and any phenylalkyl group as $R_2$ is unsubstituted.

6. A compound of claim 2, wherein ring A and any phenylalkyl group as $R_2$ is unsubstituted.

7. A compound of claim 4, wherein ring A and any phenylalkyl group as $R_2$ is unsubstituted.

8. A compound of claim 7, wherein $R_1$ is hydrogen, $R_2$ is hydrogen, $C_{2-4}$ hydroxyalkyl, $C_{1-4}$ alkyl or $C_{1-4}$ alkyl substituted by phenyl and $n$ is 2.

9. A compound of claim 8 and of formula I'

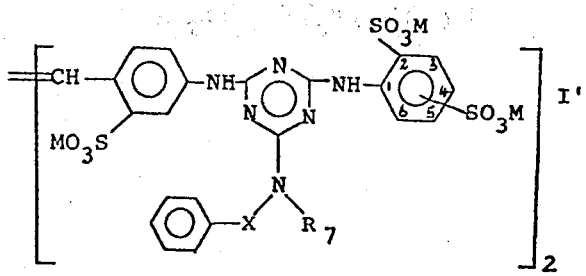

I' in which $R_7$ is hydrogen, methyl, ethyl, isopropyl, β-hydroxyethyl or group;

X is methylene, ethylene, tri- or tetramethylene, $-(CH_2)_2CH(CH_3)-$ or ethylidene; and the second $SO_3M$ moiety on the 2-($SO_3M$)-substituted phenyl group being attached at either the 4- or the 5-position.

10. A compound of claim 9, and of formula

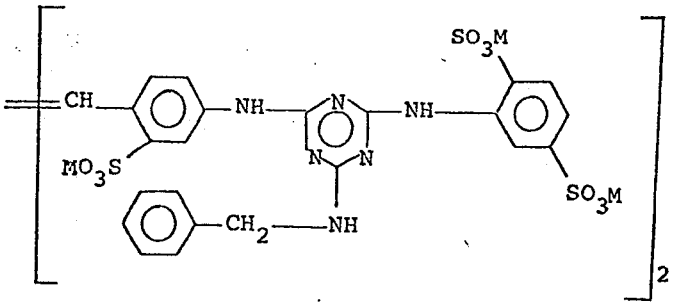

11. A compound of claim 9, and of formula

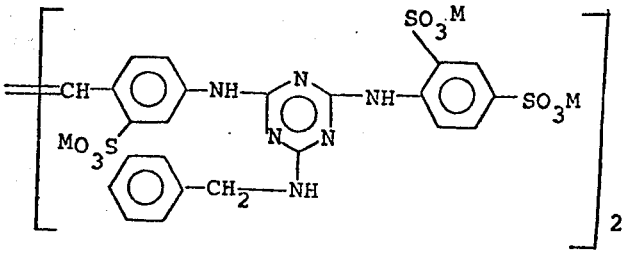

12. A compound of claim 9, and of formula

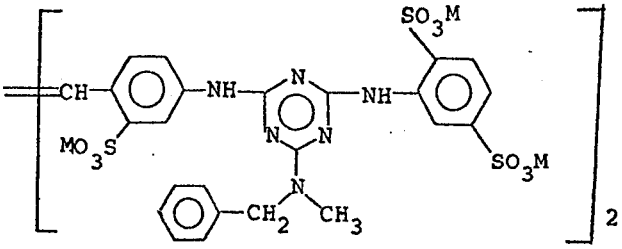

13. A compound of claim 9, and of formula
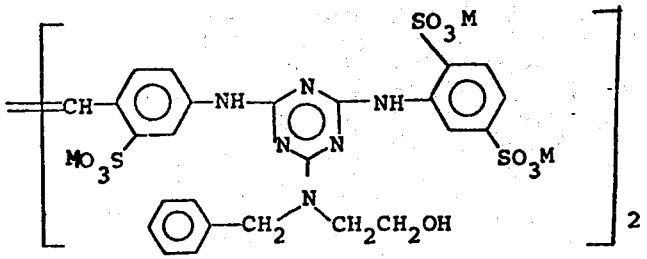
14. A compound of claim 9, and of formula
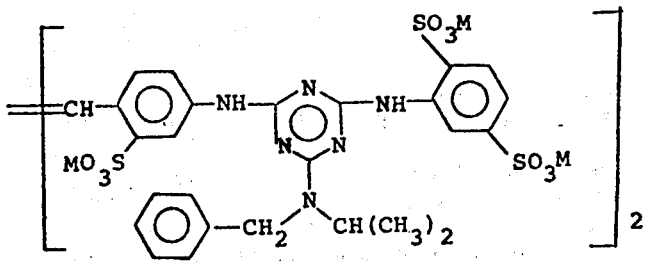
* * * * *